US009841221B2

(12) United States Patent
Dubina et al.

(10) Patent No.: US 9,841,221 B2
(45) Date of Patent: Dec. 12, 2017

(54) REFRIGERATOR

(71) Applicant: Electrolux Home Products, Inc., Charlotte, NC (US)

(72) Inventors: Paul Allen Dubina, Anderson, SC (US); Andrew D. Brown, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/048,274

(22) Filed: Feb. 19, 2016

(65) Prior Publication Data

US 2017/0241698 A1 Aug. 24, 2017

(51) Int. Cl.

| | |
|---|---|
| ***F25D 23/02*** | (2006.01) |
| ***F25D 25/02*** | (2006.01) |
| ***F25D 25/00*** | (2006.01) |
| ***A47B 88/427*** | (2017.01) |
| ***A47B 88/956*** | (2017.01) |
| ***A47B 88/407*** | (2017.01) |

(52) U.S. Cl.

CPC ..... *F25D 23/021* (2013.01); *A47B 88/407* (2017.01); *A47B 88/956* (2017.01); *F25D 25/005* (2013.01); *F25D 25/022* (2013.01); *F25D 25/025* (2013.01); *A47B 88/427* (2017.01); *A47B 2210/0021* (2013.01); *A47B 2210/0054* (2013.01); *A47B 2210/09* (2013.01)

(58) Field of Classification Search

CPC ..... F25D 23/02; F25D 23/021; F25D 23/028; F25D 2323/02; F25D 25/00; F25D 25/005; F25D 25/022; F25D 25/025; A47B 88/0044; A47B 88/0051; A47B 88/00558; A47B 2088/0059; A47B 2088/0062; A47B 88/0418; A47B 88/0422; A47B 88/956; A47B 88/427; A47B 88/407; A47B 2210/0021; A47B 2210/0054; A47B 2210/09

See application file for complete search history.

(56) References Cited

U.S. PATENT DOCUMENTS

| | | | | | |
|---|---|---|---|---|---|
| 2,063,725 | A * | 12/1936 | Clark | ..... | A47B 13/02 312/107 |
| 3,182,805 | A * | 5/1965 | Foster, Jr. | ..... | H05K 7/183 211/26 |
| 3,275,394 | A * | 9/1966 | Massinger | ..... | A47B 47/03 312/265.4 |

(Continued)

FOREIGN PATENT DOCUMENTS

| | | | | | |
|---|---|---|---|---|---|
| AT | DE 4139441 | A1 * | 6/1992 | ..... | A47B 88/0422 |
| AT | DE 9409899 | U1 * | 7/1995 | ..... | A47B 88/0422 |
| DE | EP 2631574 | A2 * | 8/2013 | ..... | F25D 23/028 |

*Primary Examiner* — Andrew M Roersma

(74) *Attorney, Agent, or Firm* — Pearne & Gordon LLP

(57) ABSTRACT

An assembly includes an enclosure including an opening providing an access to an interior of the enclosure, a door configured to open or close the opening in the enclosure. The assembly also includes a drawer side assembly supported by the enclosure and coupled to the door to move the door at least in part between an open position and a closed position. The assembly further includes a joining member configured to adjustably couple the door to the drawer side assembly. The joining member includes one or more oversized apertures relative to corresponding fasteners.

9 Claims, 11 Drawing Sheets

(56) References Cited

U.S. PATENT DOCUMENTS

| | | | | | |
|---|---|---|---|---|---|
| 3,648,626 | A * | 3/1972 | Schuster | A47B 45/00 | 108/42 |
| 4,170,391 | A * | 10/1979 | Bottger | E05D 3/04 | 248/222.11 |
| 4,281,446 | A * | 8/1981 | Umeno | B23P 11/00 | 29/432.1 |
| 4,306,379 | A * | 12/1981 | Linstromberg | F25D 23/082 | 49/482.1 |
| 5,641,240 | A * | 6/1997 | Grieser | A47B 88/0051 | 312/265.5 |
| 5,992,028 | A | 11/1999 | Wing | | |
| 6,447,083 | B1 | 9/2002 | Chiapetta et al. | | |
| 8,215,730 | B2 | 7/2012 | Brown et al. | | |
| 2003/0160552 | A1* | 8/2003 | Bacho | A47B 88/044 | 312/334.5 |
| 2004/0223831 | A1* | 11/2004 | Whitaker | B60Q 1/0441 | 411/466 |
| 2011/0210655 | A1* | 9/2011 | Brown | A47B 88/04 | 312/334.8 |

* cited by examiner

REFRIGERATOR

CROSS-REFERENCE TO RELATED APPLICATION

Not applicable

BACKGROUND OF THE INVENTION

Technical Field

The present invention relates generally to a refrigeration appliance, and more particularly to a refrigerator comprising one or more slidable doors for providing an access to the interior of the refrigerator.

Background

The manufacturing of the freezer refrigerator may require a plurality of components be assembled. Each of the plurality of components may be manufactured with a predetermined tolerance. On the other hand, the components are typically assembled into the freezer refrigerator with minimum level of total tolerance. For example, the freezer door may need to be fully aligned with the enclosure of the freezer refrigerator without being protruded for aesthetic and operational viewpoints.

When the freezer refrigerator is under repair, one or more faulty components may be separately detached from the freezer refrigerator for repair or replacement. In one example, a broken or damaged sealing surface may need to be replaced with a new sealing surface, which may require disassembling the freezer door for an easy removal of the broken or damaged sealing surface and subsequently easy installation of the new sealing surface. When the new freezer door is reassembled after the new sealing surface is installed, the freezer door may not be fully aligned with other neighboring components due to the tolerance of the freezer door. For example, the freezer door may be distorted after assembled to the guide rail, and may not be fully slidable between an open position and a closed position, which would be undesirable for the operation of the freezer refrigerator and may result in the damage of the freezer door or abutting components. As such, the freezer door may need to be provided with an adjustment mechanism for maintaining the alignment of the freezer door relative to the freezer refrigerator.

BRIEF DESCRIPTION OF THE INVENTION

The following sets forth a simplified summary of examples of the present invention for the purpose of providing a basic understanding of selected aspects of the invention. The summary does not constitute an extensive overview of all the aspects or embodiments of the invention. Neither is the summary intended to identify critical aspects or delineate the scope of the invention. The sole purpose of the summary is to present selected aspects of the invention in a simplified form as an introduction to the more detailed description of the embodiments and examples of the invention that follows the summary.

In accordance with one aspect of the present invention, an assembly is provided that comprises an enclosure comprising an opening providing access to an interior of the enclosure, and a freezer door configured to open or close the opening in the enclosure at least in part by translational movement of the door relative to the opening and the door comprising a first aperture for receiving a first fastener. The assembly also comprises a drawer slide assembly supported by the enclosure and coupled to the freezer door to support the freezer door when the freezer door is moved between an open position and a closed position. The drawer slide assembly comprises an outer extender and an inner extender in a telescopic relationship with each other. The inner extender comprises a second aperture, and a recess formed in the inner extender. The assembly further comprises a joining member adjustably coupling the freezer door to the drawer slide assembly. The joining member comprises a first portion coupled to the freezer door. The first portion comprises a third aperture aligned with the first aperture for receiving the first fastener in the first and third apertures. The joining member comprises a second portion coupled to the inner extender. The second portion comprises an embossment formed in the second portion for forming the recess in the inner extender engaged with the embossment formed in the second portion, and a fourth aperture formed in the second portion of the joining member and aligned with the second aperture for receiving a second fastener in the second and fourth apertures for adjustably engaging the second portion of the joining member with the inner extender. At least one of the second and fourth apertures are oversized relative to a cross-sectional area of the second fastener.

In accordance with another aspect of the present invention, a method is provided for assembling an assembly comprising a cabinet having an opening providing an access to an interior of the enclosure; a freezer door slidable between an open position and a closed position and comprising a plurality of first apertures formed in the freezer door; a drawer slide assembly supported by the cabinet and coupled to the freezer door to support the freezer door for sliding the freezer door at least in part between the open position and the closed position, the inner extender comprising a plurality of second apertures formed in the inner extender; and a mounting bracket adjustably securing the freezer door to the inner extender, the mounting bracket comprising a first portion coupled to the freezer door and comprising a plurality of third apertures aligned with the plurality of first apertures for receiving a plurality of the first fasteners in the first and third apertures; and a second portion coupled to the inner extender and comprising one or more embossments formed in the second portion, and a plurality of fourth apertures formed in the second portion and aligned with the plurality of second apertures, wherein at least one set of the plurality of the second and fourth apertures are oversized relative to a cross-sectional area of the second fasteners. The method includes the step of engaging the first portion of the mounting bracket with the freezer door. The method also includes the step of lightly engaging the second portion of the mounting bracket with the inner extender. The method further includes the step of adjusting the position of the mounting bracket relative to the inner extender. The method still further includes the step of fully securing the second portion of the mounting bracket to the inner extender by fully tightening the plurality of the second fasteners for forming one or more corresponding recesses on the inner extender corresponding to the positions of the embossments. The method still yet includes the step of disassembling the second portion of the mounting bracket from the freezer door. The method still includes the step of aligning the embossments of the mounting bracket with the recesses already formed in the inner extender. The method still further includes the step of fully securing the second portion of the mounting bracket to the inner extender by fully tightening the plurality of the second fasteners.

BRIEF DESCRIPTION OF THE DRAWINGS

The foregoing and other aspects of the present invention will become apparent to those skilled in the art to which the present invention relates from the detailed descriptions of examples of aspects and embodiments of the invention that follow with reference to the accompanying drawings, wherein the same reference numerals are used in the several figures to refer to the same parts or elements and in which:

FIG. 5(A) shows circular apertures, FIG. 5(B) shows elongated oval shaped apertures, and FIG. 5(C) shows rectangular shaped apertures;

FIG. 6(A) shows circular apertures, FIG. 6(B) shows elongated oval shaped apertures, and FIG. 6(C) shows oval shaped apertures;

DETAILED DESCRIPTION OF EMBODIMENTS OF THE INVENTION

Figure 1:
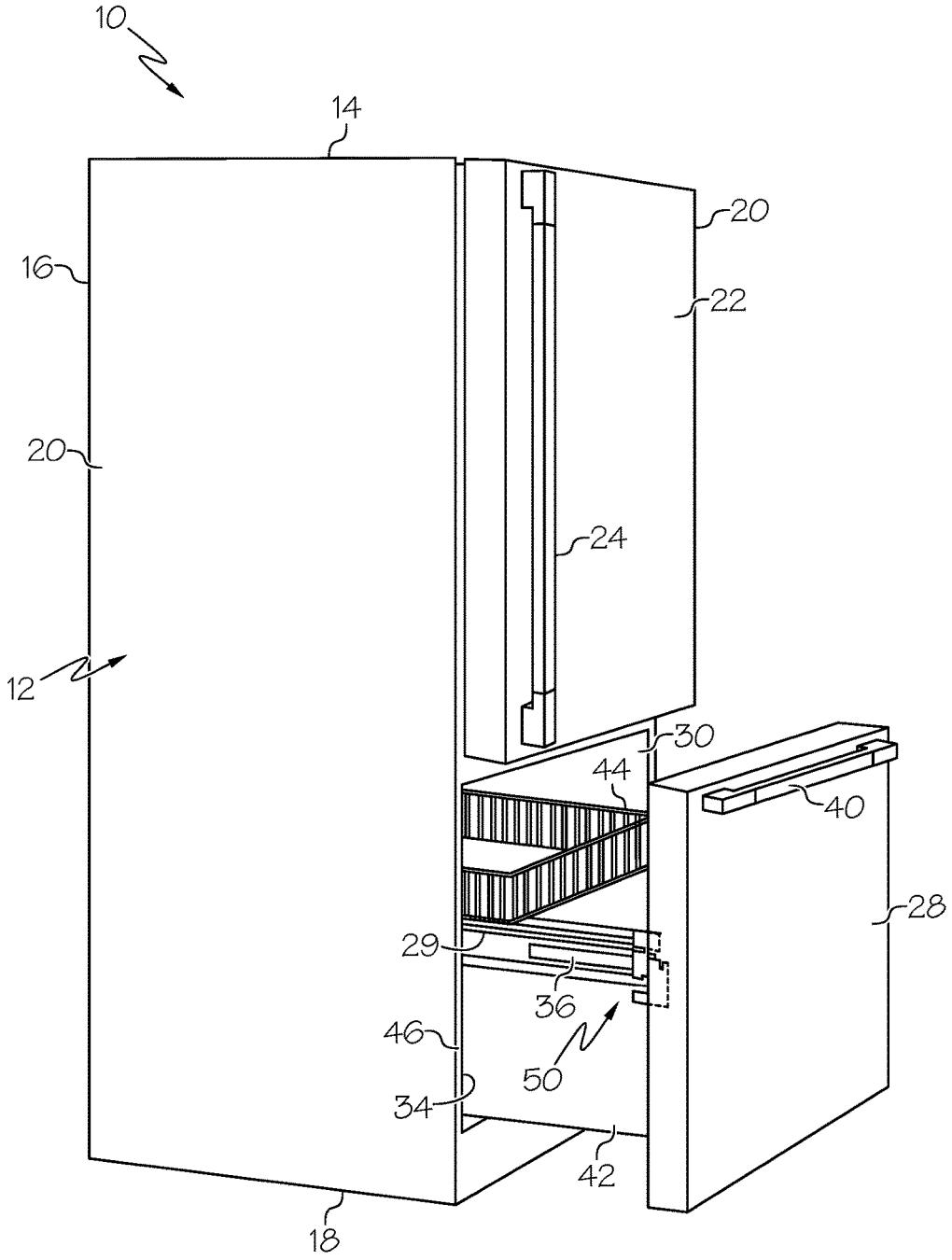
FIG. 1 illustrates a perspective view of a bottom mount refrigerator with a door of a freezer compartment slidable between an open and closed positions and supported by a drawer slide assembly according to one embodiment of the present disclosure.

Example embodiments that incorporate one or more aspects of the present invention are described below with references, in certain respects, to the accompanying drawings. These illustrated examples are not intended to be a limitation on the present invention. Thus, for example, in some instances, one or more examples of the present invention described with reference to one aspect or embodiment can be utilized in other aspects and embodiments. Moreover, certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is noted that the phrases "coupled" may be used in describing one object that is movably or fixedly coupled to another object. Similarly, phrases such as "engaged" "fastened", "mounted" or "secured" may also be used in describing one object movably or fixedly coupled to another object. On the other hand, another phrases, such as "adjustably" "loosely", or "partially" may be used in combination with "coupled", "fastened", "mounted" or "secured" to especially describe one object that is movably coupled to another object. Similarly, another phase, such as "fixedly", "fully" or "tightly" may be used in combination with "coupled", "fastened", "mounted", "engaged" or "secured" to describe one object that is non-movably coupled to another object.

It is also noted that the phrases "recess" may be used in describing a hollow space formed relative to a surface. Similarly, phrase such as "opening" or "aperture" may also be used in describing a hollow space relative to a surface to receive an object in that hollow space, and may be interchangeably used with "recess."

Referring to the example of FIG. 1, an exemplary refrigerator 10 is shown according to one embodiment of the present disclosure. The exemplary refrigerator 10 in the present disclosure is a bottom mount refrigerator, however, it is also possible to have other embodiments of a refrigerator or freezer assembly that includes a slidable door or a slidable container, including, but not limited to, a drawer-style refrigerator, a French-door refrigerator and side-by-side refrigerator. The refrigerator 10 may include an enclosure 12 in the form of a cabinet defining an interior of the cabinet, which may at least include a top wall 14, a rear wall 16, a bottom wall 18 and a pair of side walls 20. An upper portion of the interior may include a fresh food compartment that is typically maintained at or greater than 32° Fahrenheit, and a lower portion of the interior may include a freezer compartment that is typically maintained below 32° Fahrenheit. A door 22 may be hingedly provided at one side of the cabinet 12 opposite a handle 24 and close off an opening at the front of the fresh food compartment through which access can be made to the interior of the fresh food compartment.

The freezer compartment may include a freezer door 28 to selectively open or close the freezer compartment. The freezer door 28 may close off an opening 30 at the front of the freezer compartment through which access can be made to the interior of the freezer compartment. The freezer door 28 may be supported by drawer slide assembly 29 located at each side of the freezer door 28 and mounted to an inner side wall 34 of the freezer compartment in a manner familiar to those having ordinary skill in the art so that the freezer compartment can be opened by sliding the freezer door 28 out from the opening 30 and closed by sliding the freezer door 28 in toward the opening 30 by means of the drawer slide assembly 29. In one embodiment, the drawer slide assembly 29 may include telescoping drawer slide assembly. For example, the drawer slide assembly 29 may include one or more extenders that may be configured to extend from or recede to the telescoping extender when the freezer door 28 slides between the open position and the closed position.

A handle 40 may be provided to the freezer door 28 to move the freezer door 28 between an open position and closed position. One or more storage bins 42 and storage baskets 44 may be provided within the freezer compartment of the refrigerator 10 for storing food articles within the storage bins 42 and storage baskets 44. The storage bins 42 and storage baskets 44 may be coupled to the freezer door 28 and supported by telescoping drawer slide assembly 29 or other sliding mechanisms so that the storage bins 42 and storage baskets 44 may travel with the freezer door 28 as the freezer door 28 is opened and closed. Alternatively, the bins 42 and baskets 44 may be free of the door so that they may be brought outwardly and returned inwardly of the freezer compartment interior separately from the freezer door 28 on telescoping drawer slide assembly or other sliding mechanisms from which they are supported. The freezer door 28, bins 42 and baskets 44 may be supported by sliding or gliding mechanisms of various types including telescoping, drawer slide assembly mechanisms.

A sealing surface 46 may surround the opening 30 in the enclosure 12 or freezer compartment, and the freezer door 28 at its back side, which is not visible in FIG. 1, may include a door sealing surface that is complementary with the sealing surface 46 that surround the opening 30 in the freezer compartment. The sealing surface 46 and the door sealing surface may engage one another when the opening 30 is closed by the freezer door 28 so that the interior of the freezer compartment is sealed off from the exterior of the refrigerator 10. Rubber or plastic gaskets or seals or the like may be provided at the sealing surface 46 and at the complementary door sealing surface at the back side of the freezer door 28 in order to more certainly seal the freezer compartment interior from the outside environment.

As noted above, the freezer door 28 may be supported from the drawer slide assembly 29 located at each side of the freezer compartment. A separable and adjustable joining member 50 may be provided between the drawer slide assembly 29 and the freezer door 28 for mechanically coupling the drawer slide assembly 29 with the freezer door 28. As will be further described below, the joining member 50 may be separable at least in the sense that the joining member 50 can be disassembled and the freezer door 28 is separated from the drawer slide assembly 29, and removed from the front of the freezer compartment. And the joining member 50 may be adjustable at least in the sense that the attitude of the freezer door 28 in relation to the opening 30 and the enclosure 12, and the attitude of the sealing surface 46 in relation to the complementary door sealing surface at the back side of the freezer door 28 can be adjusted. In one example, the joining member 50 may comprise a mount bracket.

Figure 2:
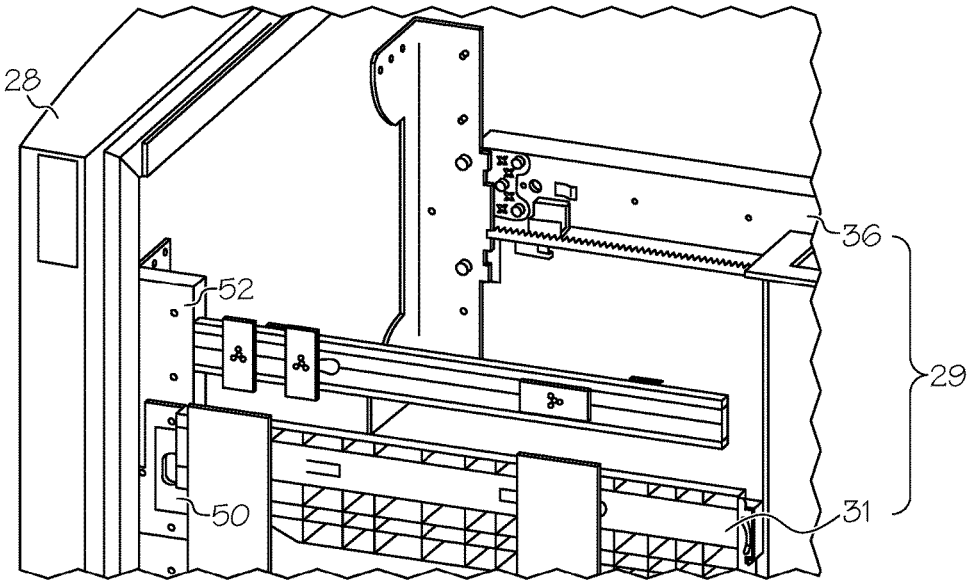
FIG. 2 is a perspective view of the freezer compartment illustrating a joining member coupled to the freezer door and the drawer slide assembly according to another embodiment of the present disclosure.
Figure 3:
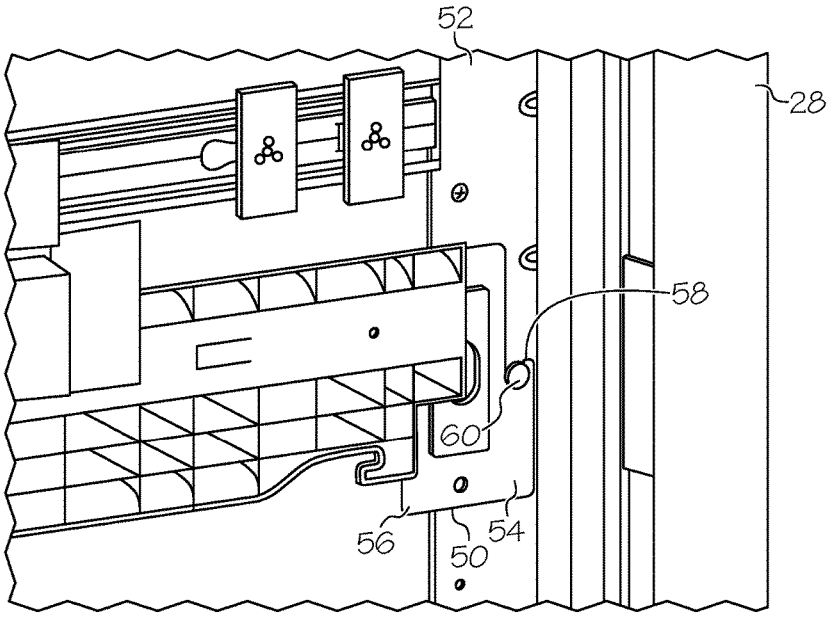
FIG. 3 is an another perspective view of the joining member of FIG. 2.

Referring to FIGS. 2 and 3, the joining member 50 with respect to the freezer door 28 and the drawer slide assembly 29 is shown. It is understood that, in FIGS. 2 and 3, the top and side wall of the freezer compartment are omitted for clearly illustrating the joining member 50. The joining member 50 may be coupled to both the drawer slide assembly 29 and the freezer door 28. As shown, the joining member 50 may be coupled to both the drawer slide assembly 29 and a support 52 that may extend from the freezer door 28. The drawer slide assembly 29 may comprise an outer extender 31 and an inner extender 36 in the form of a guide rail. In another embodiment, the drawer slide assembly 29 may include more than two extenders. The outer extender 31 may be in a telescopic relationship with the inner extender 36. The inner extender 36 and the outer extender 31 may be slidably coupled to each other by a sliding mechanism. The sliding mechanism may include roller, toothed chain, or the like. The inner extender 36 may be received by the outer extender 31 during opening or closing of the freezer door 28. The outer extender 31 may be stationary while the inner extender 36 is slidable. In another example, both the outer extender 31 and the inner extender 36 may be slidable during opening or closing of the freezer door 28.

A proximate end 54 of the joining member 50 may be mechanically coupled to the support 52 of the freezer door 28 by sliding an open slotted opening 58 of the joining member 50 into a protrusion 60 formed on the support 52 of the freezer door 28, while one or more fasteners may be used in coupling the freezer door 28 and the joining member 50. Instead of being coupled to the support 52, in another embodiment, the proximate end 54 may be directly coupled to the freezer door 28. A distal end 56 of the joining member 50 may be coupled to the inner extender 36 by using one or more fasteners as will be further described below.

Figure 4:
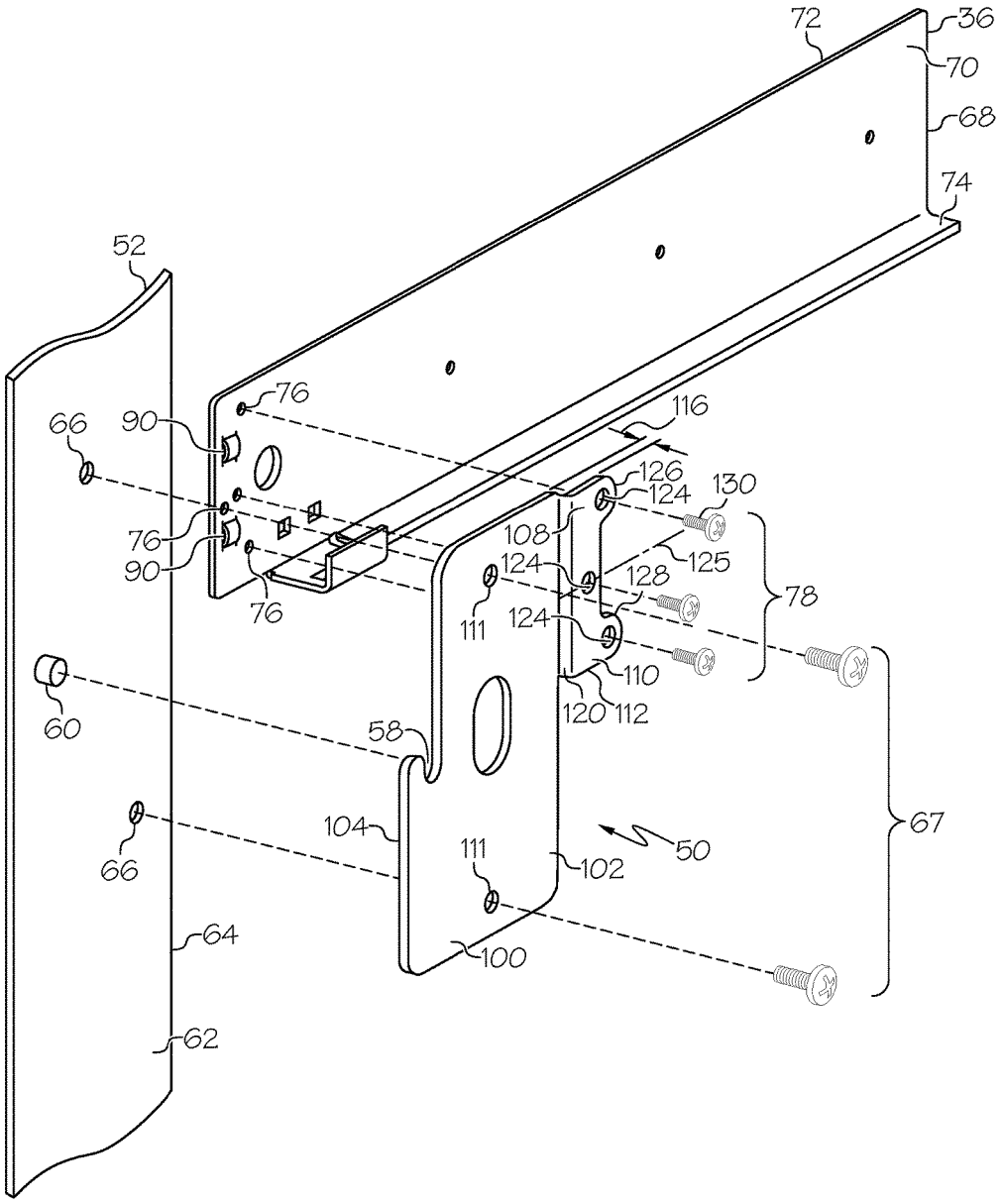
FIG. 4 is an exploded view of the joining member, an inner extender, a support and a plurality of fasteners according to still another embodiment of the present disclosure.

FIG. 4 illustrates an exploded view of the assembly including the support 52, the joining member 50, the inner extender 36, and fasteners according to another embodiment of the present disclosure. The support 52 may include first and second surfaces 62, 64, and one or more first apertures 66 for receiving one or more fasteners 67 in the corresponding first apertures 66. The fasteners 67 may include a screw or bolt/nut, each including thread and/or shank. The support 52 may also include one or more protrusions 60 formed on the first surface 62 for allowing engagement with the open slotted opening 58.

The inner extender 36 may include a first plate 68 including a first surface 70 and a second surface 72 that is opposite to the first surface 70. The inner extender 36 may further include a second plate 74 fastened to the first plate 68 in a predetermined angular relationship. In one example, the first plate 68 may be perpendicular to the second plate 74, and may be configured to receive one or more rollers, or to telescopically coupling with other parts of the inner extender 36.

The inner extender 36 may include one or more apertures 76 for receiving one or more fasteners 78 in the one or more corresponding apertures 76. The fasteners 78 may include a screw or bolt/nut, each including thread and/or shank. The one or more apertures 76 may be an exact fit to the fasteners 78 while, in another embodiment, the one or more apertures 76 may be oversized relative to the size of the fasteners 78 such that the fasteners 78 may move around within the apertures 76 before the fasteners 78 are fully secured to the inner extender 36.

Figure 5A:
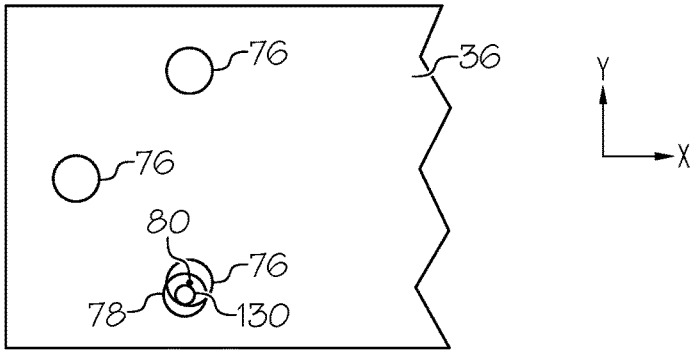
FIGS. 5(A)-5(C) are schematic front views of a portion of the inner extender including a plurality of first apertures formed in the inner extender according to still yet another embodiment of the present disclosure.
Figure 5B:
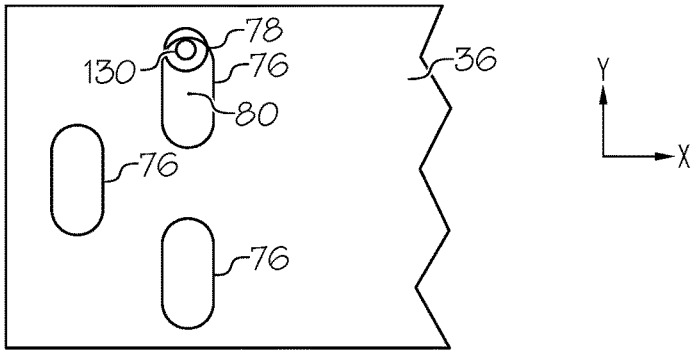
Figure 5C:
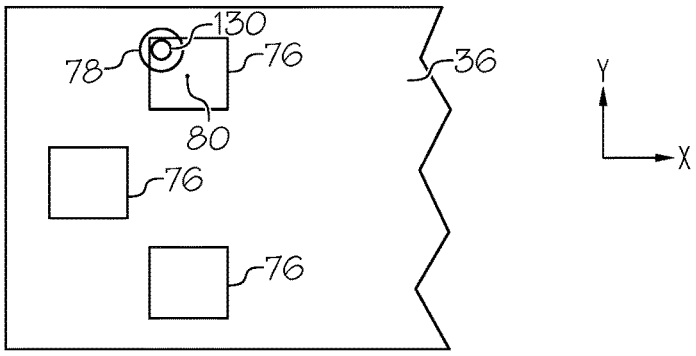

FIGS. 5(A)-5(C) illustrate examples of the apertures 76 formed in the inner extender 36. As shown, the shape and dimension of the apertures 76 may be designed to allow the fastener 78 to freely move within the apertures 76. For example, a shank 130 or a thread of the fastener 78 may move within the apertures 76 in at least one of x and y directions. The shape of the apertures 76 may include a circle, an ellipse (an elongated oval) and a rectangle, while other shapes may also be used for the apertures 76 in the inner extender 36. In one example, as shown in FIG. 5(A), the fastener 78 may be positioned away from the center 80 of the apertures 76 in both x and y direction before the fastener 78 is fully secured to the inner extender 36. In another example, the fasteners 78 may move in one of x and y directions. For example, the fasteners 78 in FIG. 5(B) may move only in y-direction within the elongated oval shaped opening 76 before the fastener 78 is secured to the inner extender 36. FIG. 5(C) shows rectangular apertures 76 where the fasteners 78 may move in at least one of x and y directions.

Referring back to FIG. 4, the joining member 50 may include a first portion 100, typically including a flat plate and comprising a first surface 102 and a second surface 104 that is opposite to the first surface 102. The first portion 100 may also include one or more apertures 111 which may be aligned with the apertures 66 in the support 52 for receiving corresponding numbers of fasteners 67 in the apertures 111, 66 to secure the first portion 100 to the support 52. The first portion 100 may further include the open slotted opening 58 for slidably coupling the first portion 100 to the protrusion 60 of the support 52 as already shown in FIG. 3.

The joining member 50 may further include a second portion 108 that may also be a flat plate having a first surface 110 and a second surface 112 opposite to the first surface 110. The second portion 108 may be raised with respect to the first portion 100 by a predetermined distance 116, by which a third portion 120 is defined. The second portion 108 may include one or more apertures 124 for receiving fasteners 78 in the apertures 124, and may be aligned with the apertures 76 formed in the inner extender 36. The second portion 108 may include two opposing end portions 126, 128 with the apertures 124 formed in each of the opposing end portions 126, 128. The opposing end portions 126, 128 may be symmetrically arranged with respect to a reference line 125, while arrangement of the end portions 126, 128 may be unsymmetrical in another embodiment. Additional aperture 124 may be formed between two opposing apertures 124 formed in the opposing end portions 126, 128.

Figure 6A:
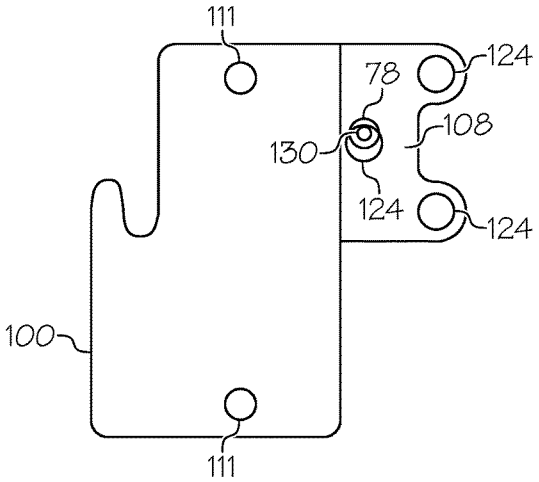
FIGS. 6(A)-6(C) are schematic front views of the joining members including a plurality of second apertures formed in the joining member according to still further yet another embodiment of the present disclosure.
Figure 6B:
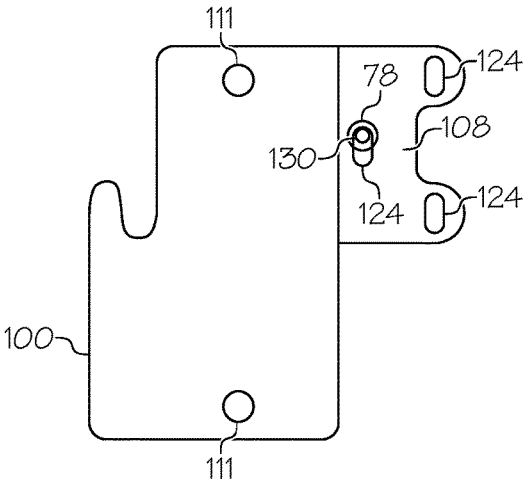
Figure 6C:
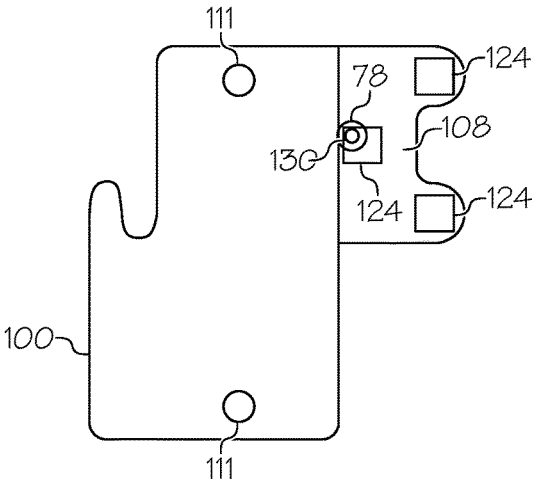

The one or more apertures 124 in the second portion 108 may be oversized relative to the fasteners 78 to allow the fasteners 78 move around within the apertures 124. In one example, a cross-sectional area of the shank or thread of the fasteners 78 may be designed such that the fasteners 78 may move around within the apertures 124 before the fasteners 78 fully secures the second portion 108 of the joining member 50 to the inner extender 36. The apertures 124 may be in the form of a circle, an ellipse (an elongated oval) and a rectangle and a curved rectangle. For example, as shown in FIG. 6(A), the apertures 124 may be a circle with radius greater than a radius of a shank 130 or a thread of the fastener 78 such that the shank 130 of the fastener 78 freely moves within the apertures 124. The fasteners 78 in FIG. 6(B) may move only in y-direction within the elongated oval shaped opening 124 before the fastener 78 is secured to the inner extender 36. FIG. 6(C) shows rectangular apertures 124 where the fasteners 78 may move in at least one of x and y directions. On the other hand, it is noted that the shape, dimension and number of the apertures 124 of the second portion 108 is not limiting, and can be in any combination thereof.

The joining member 50 may further include the third portion 120 connecting a portion of the first portion 100 and a portion of the second portion 108. The third portion 120 may be formed by bending a body having the first portion 100 and second portion 108 at predetermined angles. Alternately the third portion 120 may be a separate body connecting the first and second portions 100, 108. For example, the third portion 120 may be coupled to the first and second portions 100, 108 by one or more fasteners, respectively. In either case, the third portion 120 may be arranged to define a predetermined angular relationship between the first and second portions 100, 108. In one example, the third portion 120 may be arranged such that the first portion 100 and the second portion 108 are parallel to each other. The distance 116 by which the second portion 108 is raised relative to the first portion 100 may be configured to be equivalent to the thickness of the inner extender 36 in one embodiment, while the inner extender 36 may be thicker or thinner than the distance 116 in another embodiment.

Figure 7:
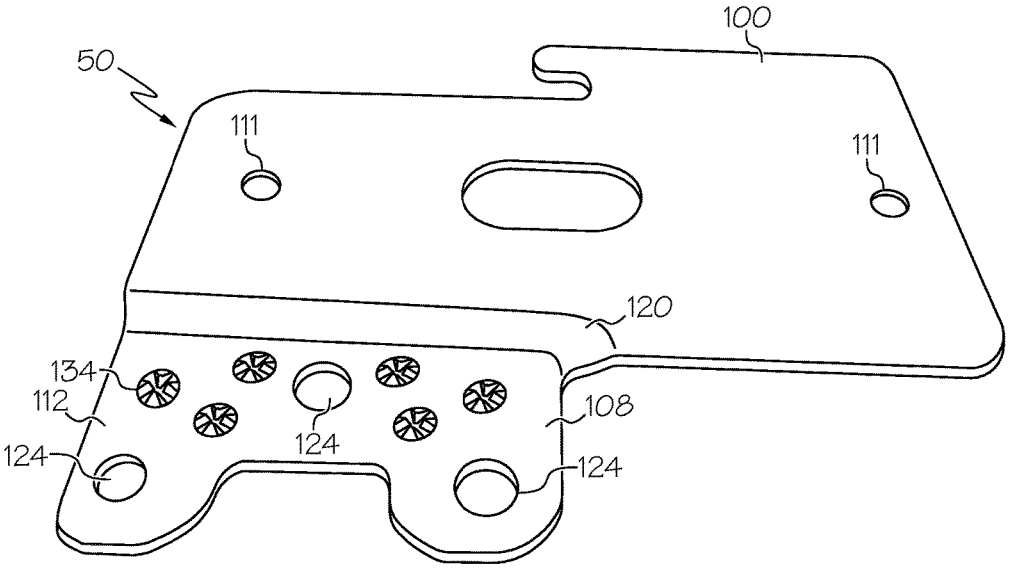
FIG. 7 is a perspective view of the joining member according to still another embodiment of the present disclosure.
Figure 8:
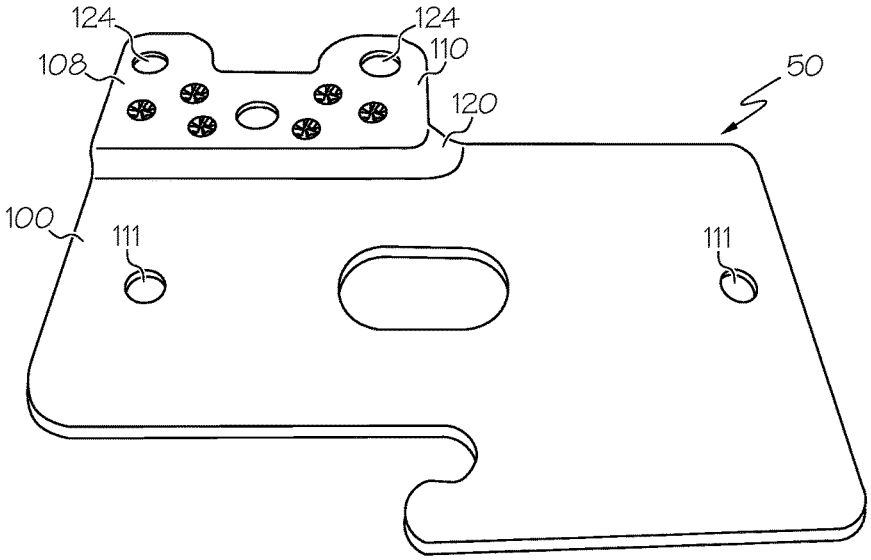
FIG. 8 is an another perspective view of the joining member of FIG. 7.

FIGS. 7 and 8 show perspective views of the joining member 50 according to yet another embodiment of the present disclosure. The joining member 50 may include the first and second portions 100, 108 coupled to the third portion 120. As shown, the third portion 120 and the first portion 100 form an obtuse angle, and so do the second portion 108 and the first portion 100. The first and second portions 100, 108 may be arranged to be in parallel to each other. As shown, a plurality of embossments 134 may be provided to the second surface 112 of the second portion 108 for engaging with the first surface 70 of the inner extender 36. Each embossment 134 may be convex with respect to the second surface 112, and may comprise four-star shaped tip patterns that may protrude in an outward direction. In other embodiments, the embossments 134 may include tip patterns with numbers and shapes different from the ones shown in FIGS. 7 and 8. The embossments 134 may be designed to form corresponding recesses or apertures in a corresponding portion of a structure engaged with the embossments 134. For example, when the second portion 108 is fully engaged with the inner extender 36 or other neighboring structure, the embossments 134 on the second portion 108 of the joining member 50 may form corresponding recesses or apertures in the inner extender 36 or other neighboring structure, which may prevent unwanted sliding of the joining member 50 relative to the inner extender 36 and provide additional alignment between the joining member 50 and the inner extender 36. The positions of the embossments and corresponding recesses may be interchanged between the joining member 50 and the inner extender 36. For example, as shown in FIG. 4, the inner extender 36 may include one or more embossments 90 to form corresponding recesses in the joining member 50.

Figure 9:
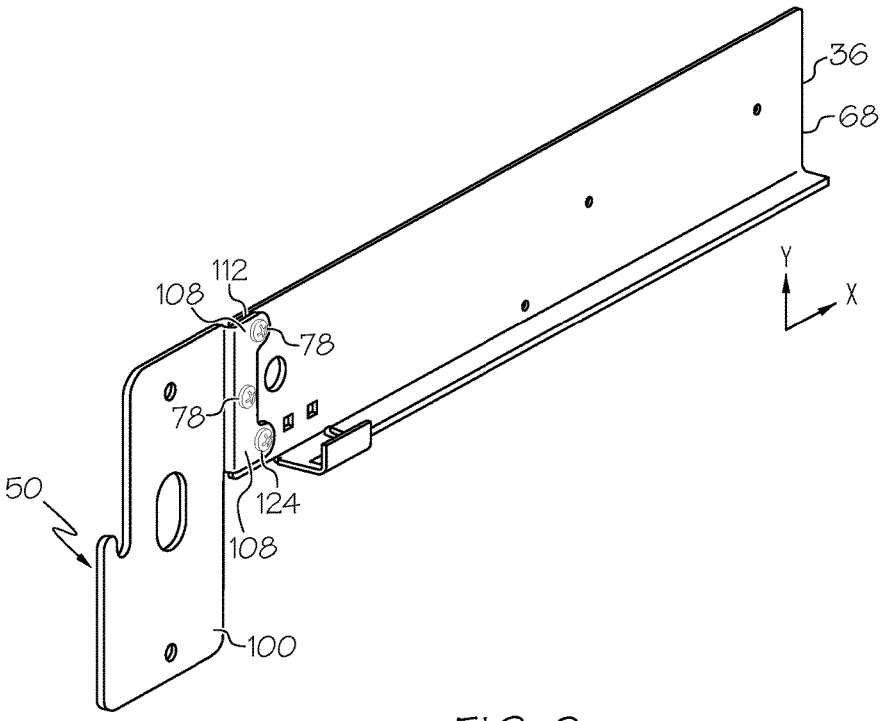
FIG. 9 is a perspective view of the joining member coupled to the inner extender according to still yet another embodiment of the present disclosure.
Figure 10:
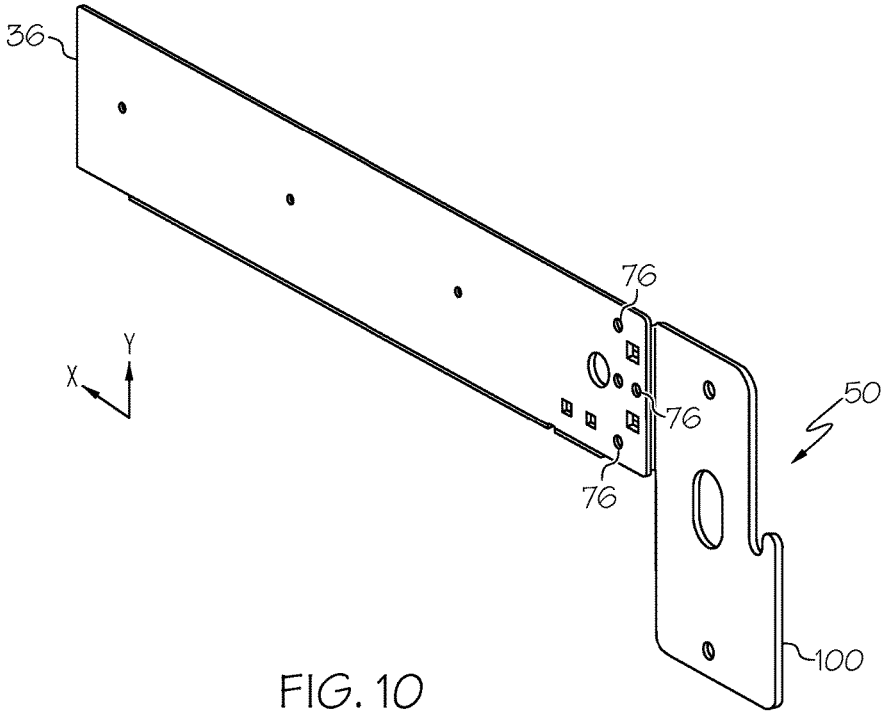
FIG. 10 is an another perspective view of the joining member coupled to the inner extender of FIG. 9.

FIGS. 9 and 10 show perspective views of the joining member 50 coupled to the first plate 68 of the inner extender 36 according to still another embodiment of the present disclosure. As shown, the second surface 112 of the second portion 108 may be engaged to the inner extender 36 after the inner extender 36 is aligned with the second portion 108 of the joining member 50. At least one of the plurality of apertures 76 and the plurality of apertures 124 may be oversized relative to the fasteners 78 for allowing the adjustment of the positions of joining member 50 at least in one of x and y directions relative to the inner extender 36 when the fasteners 78 are received in the apertures 76, 124. First, the fasteners 78 may be received by the apertures 76, 124 before the inner extender 36 and the joining member 50 are lightly secured by the fasteners 78. Subsequently, the positions of the joining member 50 may be adjusted relative to the inner extender 36 until the freezer door 28, which is fixedly coupled to the adjustable joining member 50, is fully aligned to the enclosure 12 to which the inner extender 36 is mounted. When the alignment between the joining member 50 and the inner extender 36 is complete such that the position of the freezer door 28 is adjusted to the enclosure 12, the fasteners 78 may be fully fastened to fixedly engage the joining member 50 and the inner extender 36. During a full engagement between the joining member 50 and the extender 36, the one or more embossments, which is not visible in FIGS. 9 and 10, in the second portion 108 of the joining member 50 may form corresponding recesses or apertures in the extender 36. The recesses, once formed in the inner extender 36 after alignment and full engagement between the joining member 50 and the inner extender 36, and eventually after alignment and full engagement between the freezer door 28 and the enclosure 12, may be advantageous with future alignment of the joining member 50 relative to the inner extender 36, when the parts and/or components of the refrigerator are disassembled for repair, and then re-assembled. For example, once the positions of the embossments and corresponding recesses are identified, the second portion 108 of the joining member 50 and the inner extender 36 may be immediately aligned and tightly fastened, without wasting extra time in aligning the second portion 108 and the inner extender 36 from the beginning while monitoring the positions of the freezer door 28 and the enclosure 12.

Figure 11:
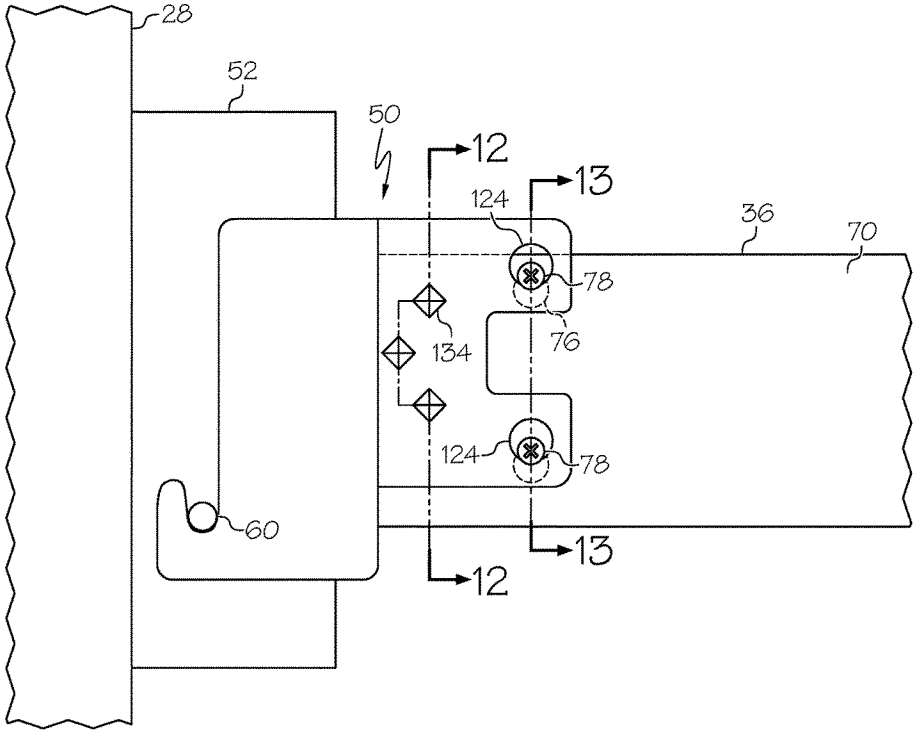
FIG. 11 is a plain view of the freezer door coupled to the inner extender by the joining member, with the freezer door aligned relative to the inner extender according to still another embodiment of the present disclosure.
Figure 12C:
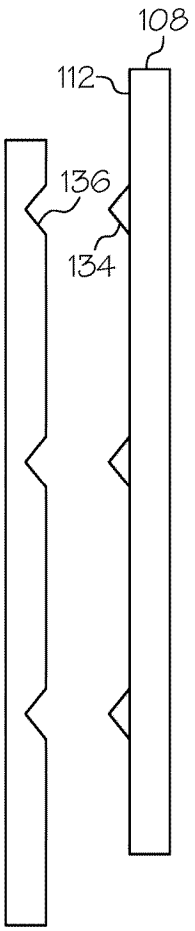
FIGS. 12(A)-12(C) are cross-sectional views showing the relative positions between embossments in the joining member and the inner extender along line 12 of FIG. 11, (A) when the embossments and the inner extender are lightly engaged to each other by lightly fastening the fastener, (B) when the embossments and the inner extender are fully engaged to each other by tightly fastening the fastener, and (C) when the embossments and the inner extender are disengaged from each other.
Figure 12B:
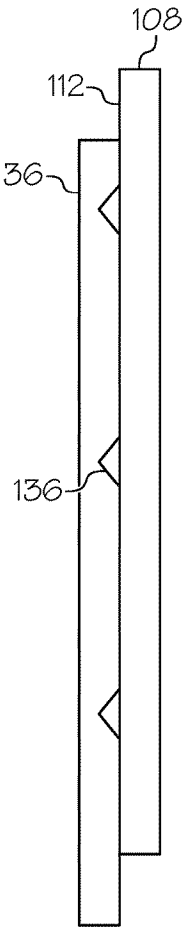
Figure 12A:
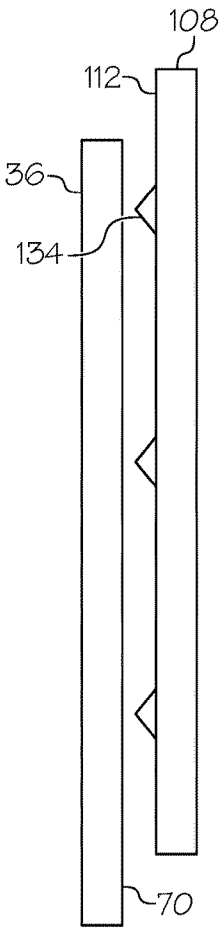
Figure 13C:
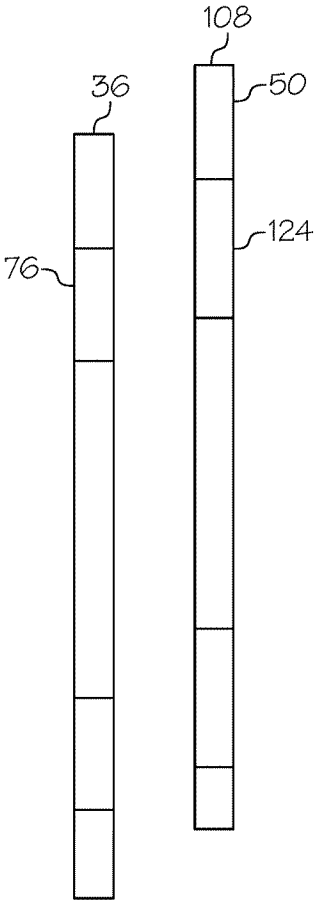
FIGS. 13(A)-13(C) are cross-sectional views showing the relative positions of the joining member and the inner extender along line 13 of FIG. 11, (A) when the joining member and the inner extender are lightly fastened to each other by lightly fastening the fastener, (B) when the joining member and the inner extender are fully engaged to each other by tightly fastening the fastener, and (C) when the joining member and the inner extender are disengaged from each other.
Figure 13B:
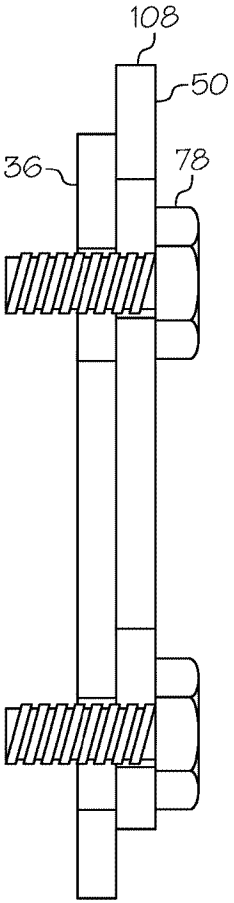
Figure 13A:
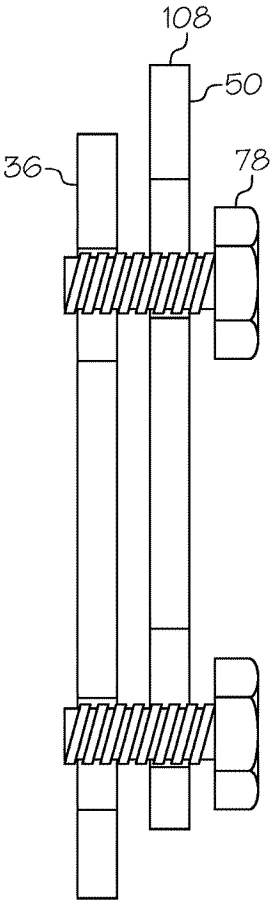

FIG. 11 shows a plain view of the support 52 extending from the freezer door 28 mounted to the inner extender 36 by the joining member 50, where the position of the freezer door 28 is adjusted relative to the inner extender 36 mounted to the enclosure 12. FIG. 11 shows that, as an example, the joining member 50 is pushed upwardly relative to the inner extender 36 with the fasteners 78 received in the apertures 76, 124 for a light engagement between the joining member 50 and the inner extender 36 while the adjustment is made. When the adjustment is being made, the embossments 134 formed on the second surface 112 of the second portion 108 of the joining member 50 may be in light contact with the inner extender 36, as shown in FIG. 12(A). FIG. 13(A) shows that the fasteners 78 may partially fasten the second portion 108 with the inner extender 36. After the adjustment is completed between the joining member 50 and the inner extender 36, and eventually between the freezer door 28 and the enclosure 12, the second portion 108 and the inner extender 36 may be secured by fully tightening the fasteners 78 as shown in FIG. 13(B). At the same time, FIG. 12(B) shows that the embossments 134 in the second portion 108 may be engaged with the first surface 70 of the inner extender 36 until corresponding recesses 136 are formed in the first surface 70 of the inner extender 36, as shown in FIG. 12(C). As such, the freezer door 28 and the enclosure 12 are fully assembled while forming the recesses 136.

The refrigerator 10 may require maintenance during its normal use. For example, the seal surface 46 may be broken or damaged with elapse of time, and sometimes needs to be repaired or replaced. Then, the freezer door 28 may be disassembled before the seal surface 46 is repaired or replaced for improved repair efficiency. In case the freezer door 28 needs to be disassembled prior to the repair of the seal surface 46, the second portion 108 of the joining member 50 and the inner extender 36 may be disengaged from each other by removing the fasteners 78 from apertures 76, 124 as shown in FIG. 13(C). Even when the joining member 50 and the inner extender 36 are pulled apart from each other, the recesses 136 may still be in the first surface 70 of the inner extender 36 as shown in FIG. 12(C). For this, the material for the inner extender 36 may be selected to be softer than the material for the second portion 108 for forming persistent recesses 136. As set forth above, the recesses 136 may remain in the inner extender 36 for aiding in future alignment of the freezer door 28 relative to the enclosure 28.

After the repair of the seal surface 46, the freezer door 28 may be reassembled simply by engaging the embossments 134 of the joining member 50 with corresponding recesses 136 already formed in the first surface 70 of the inner extender 36, without adjusting the position of the joining member 50 and the inner extender 36 with the fasteners 78 in the apertures 76, 124.

Figure 14:
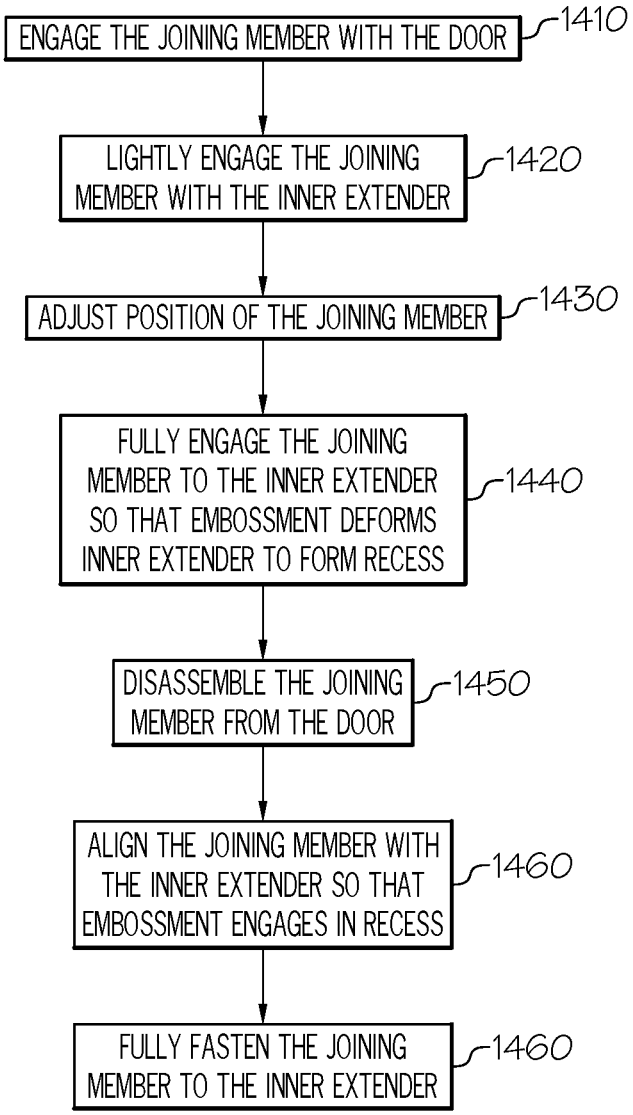
FIG. 14 is a flow chart illustrating a method of assembling the freezer door to the enclosure according to a still another embodiment of the present disclosure.

FIG. 14 is a flow chart illustrating a method of assembling the bottom mount refrigerator according to a still another embodiment of the present disclosure. It may be understood that the sequence of steps depicted in FIG. 14 is for illustrative purposes only, and is not meant to limit the method in any way as it is understood that the steps may proceed in a different logical order, additional or intervening steps may be included, or described steps may be divided into multiple steps, without detracting from the invention. The method in FIG. 14 may be incorporated into assembling steps for the bottom mount refrigerator, such as prior to or as part of any assembling steps. The method of FIG. 14 may also be a stand-alone process.

The method of FIG. 14 begins with a step 1410 where the first portion 100 of the joining member 50 may be engaged with the support 52 of the freezer door 28. The first portion 100 may be fixedly engaged with the support 52 by fasteners 67 or protrusion 60 received in the open slotted opening 58. It may also be understood that, while the first portion 100 may be engaged with the support 52 of the freezer door 28, the first portion 100 may also be directly engaged with the freezer door 28.

In the next step 1420, the joining member 50 and the inner extender 36 may be lightly engaged. At least one of the apertures 76, 124 of the joining member 50 and the inner extender 36, respectively, may be oversized relative to the fasteners 78. In one example, the apertures 76 may be oversized while the apertures 124 may not. In another example, the apertures 76 may not be oversized while the apertures 124 may be oversized. Still in another example, both apertures 76, 124 may be oversized. Once the fasteners 78 are received in the both apertures 76, 124, the fasteners 78 may be loosely fastened to allow a light engagement between the joining member 50 and the inner extender 36.

In the next step 1430, the position of the joining member 50 may be adjusted relative to the inner extender 36 before a full alignment between the freezer door 28 and the enclosure 12 is accomplished.

In the next step 1440, the second portion of 108 the joining member 50 may be fully engaged to the inner extender 36 by tightening the fasteners 78 until the second surface 112 of the second portion 108 is in full contact with the first surface 70 of the inner extender 36, during which one or more recesses 136 may be formed on the first surface 70 of the inner extender 36, which corresponds to the positions of the embossments 134.

In the next step 1450, the joining member 50 may be disassembled from the freezer door 28 by unfastening the fasteners 78. For example, when the seal surface 46 needs to be replaced, the freezer door 28 may need to be disassembled from the refrigerator 10.

In the next step 1460, the joining member 50 may be re-assembled by aligning the embossments 134 of the joining member 50 with the recesses 136 already formed in the inner extender 36 in the step 1440. Subsequently, in the step

1470, the fasteners 78 may fully secure the joining member 50 to the inner extender 36 by fully tightening the fasteners 78.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A method of assembling an assembly comprising a cabinet having an opening providing an access to an interior of the cabinet; a freezer door slidable between an open position and a closed position and comprising a plurality of first apertures formed in the freezer door; a drawer slide assembly supported by the cabinet and coupled to the freezer door to support the freezer door for sliding the freezer door at least in part between the open position and the closed position, the drawer slide assembly comprising an outer extender and an inner extender in a telescopic relationship with each other, the inner extender comprising a plurality of second apertures formed in the inner extender; and a mounting bracket adjustably securing the freezer door to the inner extender, the mounting bracket comprising a first portion coupled to the freezer door and comprising a plurality of third apertures aligned with the plurality of first apertures for receiving a plurality of first fasteners in the first and third apertures; and a second portion coupled to the inner extender and comprising one or more embossments formed in the second portion, and a plurality of fourth apertures formed in the second portion and aligned with the plurality of second apertures for receiving a plurality of second fasteners, wherein at least one set of the plurality of the second and fourth apertures is oversized relative to a cross-sectional area of a corresponding one of the plurality of second fasteners, wherein the method comprises:

engaging the first portion of the mounting bracket with the freezer door;

engaging the second portion of the mounting bracket with the inner extender such that the one or more embossments abut a surface of the inner extender;

adjusting a position of the mounting bracket relative to the inner extender;

fully securing the second portion of the mounting bracket to the inner extender by fully fastening the plurality of the second fasteners such that the one or more embossments plastically deform the inner extender so as to form one or more corresponding recesses on the inner extender corresponding to positions of the one ore more embossments;

disassembling the second portion of the mounting bracket from the freezer door;

aligning the one or more embossments of the mounting bracket with the one or more corresponding recesses that were previously formed on the inner extender; and fully securing the second portion of the mounting bracket to the inner extender by fully tightening the plurality of the second fasteners so that the one or more embossments are positioned within the one or more corresponding recesses.

2. The method according to claim 1, wherein engaging the first portion of the mounting bracket with the freezer door comprises fixedly engaging the first portion of the mounting bracket to the freezer door.

3. The method according to claim 1, wherein at least one of the plurality of the first and second apertures comprises one of a circle, an ellipse, an elongated oval, and a rectangle.

4. The method according to claim 1, wherein engaging the second portion of the mounting bracket with the inner extender comprises fastening the mounting bracket with the inner extender such that a plurality of the second fasteners are movable in both the second and fourth apertures.

5. The method according to claim 1, wherein adjusting the position of the mounting bracket relative to the inner extender comprises adjusting the position of the mounting bracket relative to the inner extender with the plurality of first fasteners received in the first and third apertures.

6. The method according to claim 1, wherein adjusting the position of the mounting bracket relative to the inner extender comprises adjusting the position of the mounting bracket relative to the inner extender until the freezer door is fully aligned with the cabinet.

7. The method according to claim 1, wherein disassembling the second portion of the mounting bracket from the freezer door comprises disassembling the freezer door from the refrigerator by removing the plurality of the second fasteners.

8. The method according to claim 1, wherein aligning the one or more embossments of the mounting bracket with the one or more corresponding recesses comprises receiving the embossments of the mounting bracket in the one or more corresponding recesses in the inner extender.

9. The method according to claim 1, wherein a third portion couples the first portion and the second portion.

* * * * *